US008446343B2

(12) United States Patent
Akimoto et al.

(10) Patent No.: US 8,446,343 B2
(45) Date of Patent: May 21, 2013

(54) IMAGE DISPLAY APPARATUS

(75) Inventors: Hajime Akimoto, Kokubunji (JP); Hiroshi Kageyama, Hachioji (JP)

(73) Assignees: Hitachi Displays, Ltd., Chiba-ken (JP); Panasonic Liquid Crystal Display Co., Ltd., Hyigi-ken (JP)

( * ) Notice: Subject to any disclaimer, the term of this patent is extended or adjusted under 35 U.S.C. 154(b) by 1216 days.

(21) Appl. No.: 11/298,470

(22) Filed: Dec. 12, 2005

(65) Prior Publication Data

US 2006/0158398 A1 Jul. 20, 2006

(30) Foreign Application Priority Data

Jan. 17, 2005 (JP) ..... 2005-008616

(51) Int. Cl.
*G09G 3/30* (2006.01)

(52) U.S. Cl.
USPC ..... 345/76

(58) Field of Classification Search
USPC ..... 345/76–83, 204
See application file for complete search history.

(56) References Cited

U.S. PATENT DOCUMENTS

| | | | | |
|---|---|---|---|---|
| 5,567,997 | A * | 10/1996 | Suzuki et al. | 307/127 |
| 2003/0067424 | A1* | 4/2003 | Akimoto et al. | 345/55 |
| 2003/0107535 | A1* | 6/2003 | Numao | 345/76 |
| 2003/0122496 | A1 | 7/2003 | Lee et al. | |
| 2004/0041750 | A1 | 3/2004 | Abe | |
| 2004/0080474 | A1* | 4/2004 | Kimura | 345/82 |
| 2004/0189615 | A1 | 9/2004 | Osame et al. | |
| 2005/0001830 | A1 | 1/2005 | Osame et al. | |
| 2005/0104815 | A1* | 5/2005 | Komiya et al. | 345/76 |
| 2007/0132677 | A1 | 6/2007 | Osame et al. | |
| 2007/0139315 | A1 | 6/2007 | Abe | |

FOREIGN PATENT DOCUMENTS

| | | | |
|---|---|---|---|
| JP | 2003-122301 | | 10/2001 |
| JP | 2003-195811 | A | 7/2003 |
| JP | 2004-347626 | A | 12/2004 |
| KR | 2003-0058210 | A | 7/2003 |
| KR | 10-2004-0111032 | A | 12/2004 |

OTHER PUBLICATIONS

R.M.A. Dawson et al., "Design of an Improved Pixel for a Polysilicon Active-Matrix Organic LED Display", SID 98 Digest, pp. 11-14.

* cited by examiner

*Primary Examiner* — Sumati Lefkowitz
*Assistant Examiner* — Robert E Carter, III
(74) *Attorney, Agent, or Firm* — Stites & Harbison PLLC; Juan Carlos A. Marquez, Esq.; Nicholas B. Trenkle, Esq.

(57) ABSTRACT

An image display apparatus capable of effecting displays high in both reliability and luminance. With the image display apparatus, a transistor switch is provided between a light emitting device and a drive transistor, and a voltage value expressed by formula (a gate voltage at an on-time of the transistor switch)—(the threshold voltage Vth of the drive transistor) is rendered smaller than a value of a voltage applied to a common electrode of the light emitting device.

6 Claims, 6 Drawing Sheets

IMAGE DISPLAY APPARATUS

CLAIM OF PRIORITY

The present application claims priority from Japanese application JP 2005-008616 filed on Jan. 17, 2005, the content of which is hereby incorporated by reference into this application.

FIELD OF THE INVENTION

The invention relates to an image display apparatus capable of effecting display at a high luminance with high reliability.

BACKGROUND OF THE INVENTION

A conventional technology is described hereinafter with reference to FIGS. 8 and 9.

To start with, a structure according to an example of the conventional technology is described. FIG. 8 is a pixel circuit diagram of an organic EL (electroluminescence) display using the conventional technology. Respective pixels 213 are provided with an organic EL device 201, and the organic EL device 201 has one end connected to a common electrode 208 and the other end connected to a power supply line 207 via a power supply switch 202, and a drive TFT (Thin-Film-Transistor) 203. A reset switch 204 interconnects the gate and the drain of the drive TFT 203. Further, the gate of the drive TFT 203 is coupled to a signal line 206 via a signal storage capacitor 205. The power supply switch 202 is controlled by a power supply control line (PWR) 211, and the reset switch 204 is controlled by a reset control line (RST) 210.

Next, an operation of the example of the conventional technology is described with reference to FIG. 9. FIG. 9 is an operation timing chart at a time of writing a signal voltage to the pixel according to the conventional technology, that is, at a data (DT) input time (DTIN), and a luminescence display time (ILMI). In this case, since a pMOS is used for the power supply switch 202, and the reset switch 204, respectively, as shown in FIG. 8, lower parts of respective waveforms, shown in FIG. 9, correspond to ON of the respective switches, and upper parts thereof correspond to OFF.

With the pixel selected for writing, at the time (DTIN) of writing the signal voltage in the first half of one frame period (1FRM), the power supply switch 202 is first turned ON by the power supply control line (PWR) 211, and subsequently, the reset switch 204 is turned ON by the reset control line (RST) 210. At this point in time, current flows from the power supply line 207 to the organic EL device 201 via the drive TFT 203 connected to a diode, and the power supply switch 202.

Next, when the power supply switch 202 is turned OFF by the power supply control line (PWR) 211, the drive TFT 203 is turned OFF at a time when a voltage at a drain end of the drive TFT 203 turns to a threshold voltage Vth. At this point in time, a predetermined signal voltage (data signal DT) has already been applied to the signal line 206, and a difference between the signal voltage and the threshold voltage Vth is inputted to the signal storage capacitor 205.

Subsequently, the reset switch 204 is turned OFF by the reset control line (RST) 210, whereupon the voltage of the data signal DT is stored in the signal storage capacitor 205, thereby completing writing of the signal voltage to the pixel.

At the luminescence display time (ILMI) corresponding to the latter half of one frame period (1FRM), a scanning signal SS (predetermined triangular wave signal) is inputted to all the pixels via the signal line 206, and the power supply switch 202 is turned ON by the power supply control line (PWR) 211. At this point in time, if the triangular wave signal applied to the signal line 206 is equivalent to the pre-written signal voltage, the threshold voltage Vth is inputted to the gate of the drive TFT 203, so that a luminescence period of the organic EL device 201 is determined according to the pre-written signal voltage. As a result, the organic EL device 201 undergoes luminescence for luminescence time corresponding to the signal voltage for an image, so that a viewer can recognize the image with gradation.

Incidentally, as the data signal DT or the scanning signal SS is inputted to the signal line 206 depending on respective predetermined periods within the one frame period, these signals are denoted by DT/SS in the figure.

The conventional example described is disclosed in detail in, for example, JP-A No. 122301/2003, and so forth.

A pixel circuit of an image display system using organic EL devices, and a method of driving the same are disclosed in SID 98 Digest of Technical Papers, 1998, pp. 11-14.

SUMMARY OF THE INVENTION

As for the organic EL display, there have been reported a bottom-emission type for effecting luminescence display in the downward direction of a TFT substrate, and a top-emission type for effecting luminescence display in the upward direction of the TFT substrate. It has been known that both the types have merits and demerits. The bottom-emission type is at a disadvantage from the standpoint of attaining higher definition and a longer service life because a luminescent layer cannot be provided over a TFT circuit, rendering it impossible to enlarge a luminescence region. On the other hand, the top-emission type is at a disadvantage from the standpoint of attaining enhancement in luminance of luminescence because display is effected with luminescence transmitted through a thin-film cathode metal film provided in the upper part of a luminescent layer, thereby losing portions of the luminescence.

In order to enhance luminance of the luminescence of the top-emission type, it is preferable to provide a transparent, electrically conductive film such as ITO in the upper part of the luminescent layer instead of providing the thin-film cathode metal film in the upper part of the luminescent layer. However, because the transparent, electrically conductive film such as ITO acts as a hole implantation layer against the luminescent layer, it is necessary to use an anode-grounding circuit reverse in conductivity to a conventional pixel drive circuit.

In order to substitute the anode-grounding circuit for the conventional pixel drive circuit, it is sufficient to use an nMOS in place of a pMOS. However, the nMOS has a problem of long-term reliability that is inferior to that of the pMOS. The pMOS is driven by a hole current, and holes have the property of being not easily implanted into a silicon dioxide gate insulator while the nMOS is driven by electron current, and electrons have the property of being easily implanted into the silicon dioxide gate insulator.

If deterioration occurs in the nMOS due to electron implantation into the gate insulator, this will cause a drive capacity against the luminescent layer of the organic EL device to decrease, thereby raising the risk of causing deterioration in luminance. When luminance of the luminescence of the luminescent layer is small, in particular, most of a power supply voltage is applied to the pixel drive circuit, so that deterioration may progresses in the pixel drive circuit using the nMOS.

Some of representative means for carrying out the invention, disclosed in the present specification, are shown as follows.

In accordance with one aspect of the invention, there is provided an image display apparatus comprising a gradation signal voltage generation circuit, a pixel having a light emitting device with luminance being controlled in analogue by the gradation signal voltage generation circuit, and a luminance control circuit of the light emitting device, and a display region where a plurality of the pixels are arranged in a matrix fashion, wherein a transistor switch having a drain side thereof, connected to one end of the light emitting device, and a source side thereof, connected to the luminance control circuit, a gate voltage of the transistor switch being controlled on a binary basis of ON/OFF, is provided between the light emitting device and the luminance control circuit, and a value of the gate voltage when the transistor switch is in an on-condition is smaller than a value of a voltage applied to the other end of the light emitting device.

Further, the invention may provide an image display apparatus comprising a gradation signal voltage generation circuit, a pixel having a light emitting device with luminance being controlled in analogue by the gradation signal voltage generation circuit, and a luminance control circuit of the light emitting device, and a display region where a plurality of the pixels are arranged in a matrix fashion, wherein a transistor switch having a drain side thereof, connected to one end of the light emitting device, and a source side thereof, connected to the luminance control circuit, a gate voltage of the transistor switch being controlled on a binary basis of ON/OFF, is provided between the light emitting device and the luminance control circuit, and the transistor switch is controlled such that an operating point thereof at an on-time falls in a saturation region.

Still further, the invention may provide an image display apparatus comprising a gradation signal voltage generation circuit, a pixel having a light emitting device with luminance being controlled in analogue by the gradation signal voltage generation circuit, and a luminance control circuit of the light emitting device, and a display region where a plurality of the pixels are arranged in a matrix fashion, wherein the luminance control circuit comprises a first transistor switch, a gate voltage of the first transistor switch being controlled on a binary basis of ON/OFF, a second transistor switch having a drain side thereof, connected to one end of the light emitting device, and a source side thereof, connected to the luminance control circuit, a gate voltage of the second transistor switch being controlled on a binary basis of ON/OFF, provided between the light emitting device and the luminance control circuit, and a gate voltage amplitude of the second transistor switch is smaller than a gate voltage amplitude of the first transistor switch.

The invention is advantageous in that deterioration of the pixel drive circuit using the nMOS can be avoided.

DETAILED DESCRIPTION OF THE PREFERRED EMBODIMENTS

Embodiments of an image display apparatus according to the invention are described in detail hereinafter with reference to the accompanying drawings.

First Embodiment

Figure 1:
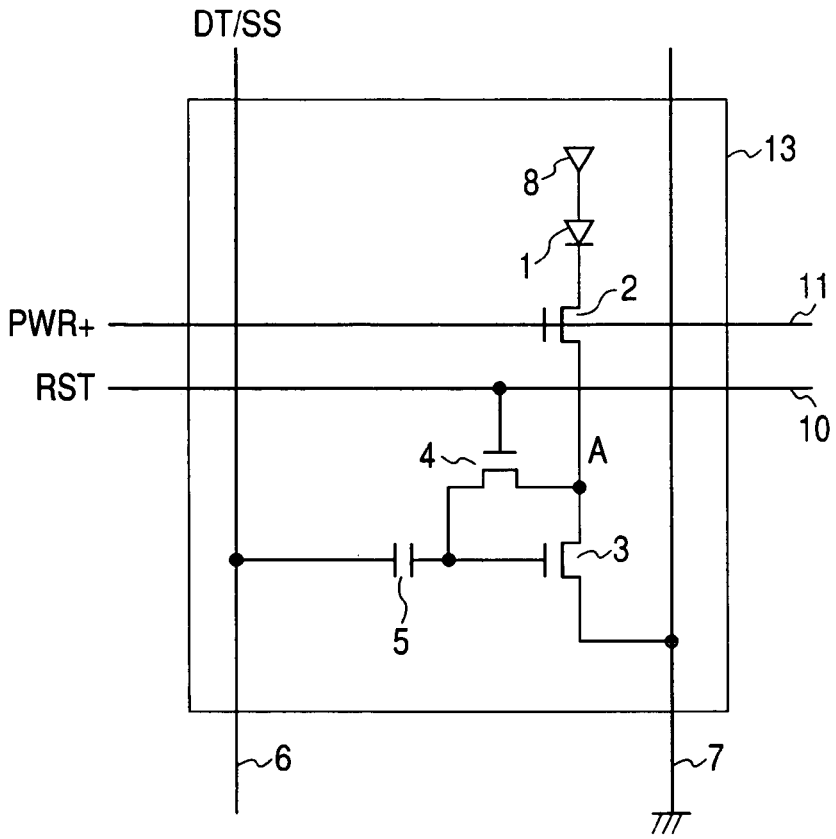
FIG. 1 is a pixel circuit diagram of an organic EL display showing a first embodiment of an image display apparatus according to the invention.
Figure 8:
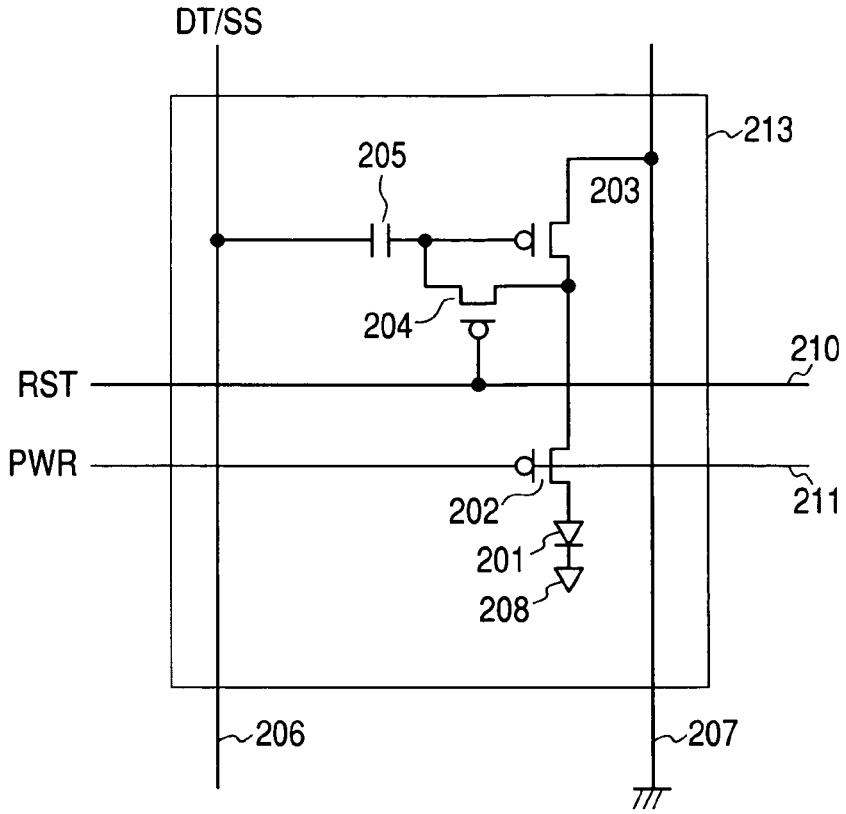
FIG. 8 is a pixel circuit diagram of an organic EL display using a conventional technology.

A configuration and an operation of a first embodiment of the invention are described in sequence hereinafter with reference to FIGS. 1 to 4. FIG. 1 is a pixel circuit diagram of an organic EL display according to the first embodiment of the invention. A pixel 13 is provided with an organic EL device 1. The organic EL device 1 has one end on an anode side thereof, connected to a transparent common electrode 8 with a positive voltage applied thereto, and the other end connected to a ground line 7 via a power supply switch 2, and a drive TFT 3. A reset switch 4 interconnects the gate and the drain of the drive TFT 3. Further, the gate of the drive TFT 3 is coupled to a signal line 6 via a signal storage capacitor 5. The power supply switch 2 is controlled by a drive voltage PWR+applied via a power supply control line 11, and the reset switch 4 is controlled by an RST signal applied via a reset control line 10. Such a pixel circuit configuration as described above corresponds to a pixel circuit configuration according to the conventional example, as described with reference to FIG. 8, except that the direction of current application is reversed, and an nMOS is substituted for the pMOS, however, the feature of the invention lies in the drive voltage PWR+applied via the power supply control line 11.

Next, the operation of the present embodiment is described with reference to FIG. 2.

Figure 2:
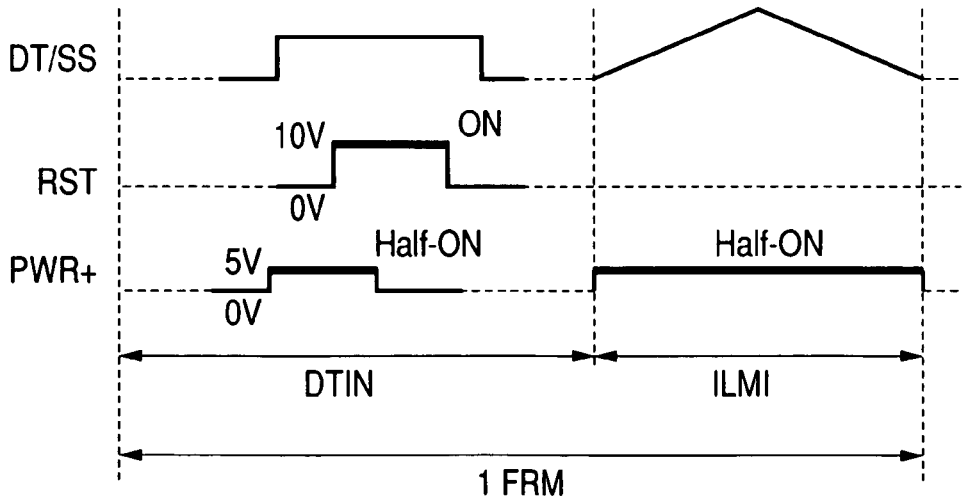
FIG. 2 is an operation timing chart of a pixel according to the first embodiment.

FIG. 2 is an operation timing chart at a time (DTIN) of writing a signal voltage to the pixel, and a luminescence display time (ILMI), in the first half of one frame period (1FRM) according to the present embodiment. In this case, since an nMOS is used for the power supply switch 2, and the reset switch 4, respectively, as shown in FIG. 2, upper parts of respective waveforms shown in FIG. 2 correspond to ON of the respective switches, and lower parts thereof correspond to OFF.

With the pixel selected for writing, the power supply switch 2 is first turned ON by the drive voltage PWR+applied via the power supply control line 11 at the signal voltage write-time (DTIN) in the first half of one frame period (1FRM), and subsequently, the reset switch 4 is turned ON by the RST signal applied via the reset control line 10. At this point in time, current flows from the common electrode 8 to the organic EL device 1 via the drive TFT 3 connected to a diode, and the power supply switch 2.

Next, when the power supply switch 2 is turned OFF by the drive voltage PWR+of the power supply control line 11, the drive TFT 3 is turned OFF at a time when a voltage at a drain end of the drive TFT 3 turns to a threshold voltage Vth. At this point in time, a predetermined data signal voltage DT has already been applied to the signal line 6, and a difference between the signal voltage and the threshold voltage Vth is inputted to the signal storage capacitor 5.

Subsequently, the reset switch 4 is turned OFF by the signal RST of the reset control line 10, whereupon the signal voltage is stored in the signal storage capacitor 5, thereby completing writing of the signal voltage to the pixel.

At the luminescence display time (ILMI) corresponding to the latter half of the one frame period (1FRM), a predetermined triangular wave signal (scanning signal) SS of an analog signal is inputted to all the pixels via the signal line 6, and the power supply switch 2 is turned ON by the drive voltage PWR+of the power supply control line 11. If the triangular wave signal SS applied to the signal line 6 is equivalent to the pre-written signal voltage at this point in time, the threshold voltage Vth is inputted to the gate of the drive TFT 3, so that a luminescence period of the organic EL device 1 is determined according to the pre-written signal voltage. As a result, the organic EL device 1 undergoes luminescence for luminescence time corresponding to the signal voltage for an image, so that a viewer can recognize the image with gradation.

Incidentally, as the data signal DT or the scanning signal SS is inputted to the signal line 6 according to respective predetermined periods within the one frame period, these signals are denoted by DT/SS in the figures.

Figure 9:
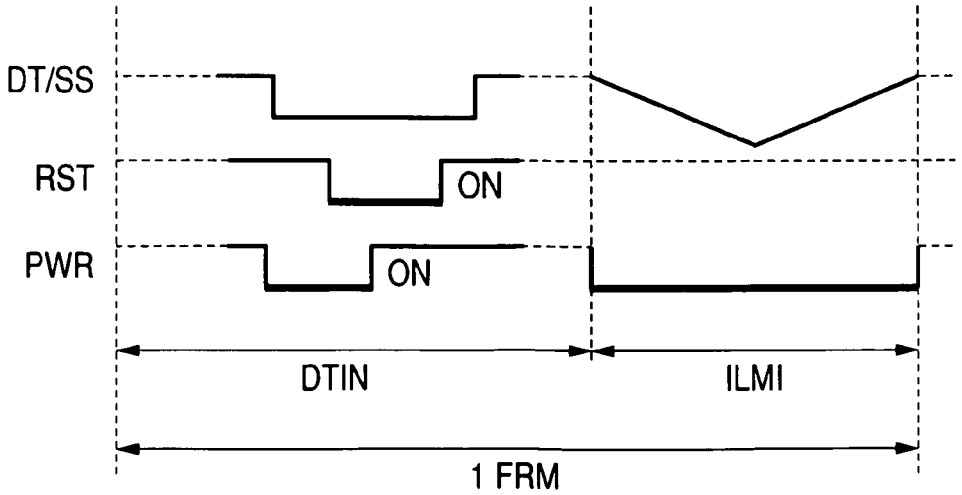
FIG. 9 is an operation timing chart of a pixel according to the conventional technology.

The operation of the present embodiment is basically similar to that of the conventional example described with reference to FIG. 9, however, the present embodiment differs largely from the latter in that an on-voltage of the power supply switch 2, caused by the drive voltage PWR+of the power supply control line 11, is not 10 V representing complete-ON, but is 5 V representing half-ON. This means that an on-condition of the power supply switch 2 is not a complete on-condition causing the power supply switch transistor to be in an unsaturation condition, but an incomplete-ON causing the power supply switch transistor to be in a saturation condition. In this case, a voltage at a point "A" shown in FIG. 1, corresponding to a source point of the power supply switch 2, will not be a half-ON voltage at (5 V−Vth) or higher even if the power supply switch 2 is turned ON. The reason for this is because the power supply switch 2 is turned OFF when the voltage at the point "A" rises up to the voltage at (5 V−Vth).

Now, with the present embodiment, a luminescence voltage of the organic EL device 1, applied to the common electrode 8, is about 10 V for green color and red color, respectively, and about 11 V for blue color. When the predetermined triangular wave signal SS is inputted via the signal line 6 at the luminescence display time (ILMI) corresponding to the latter half of the one frame period, the drive TFT 3 is weakly turned ON on the rising edge as well as on the falling edge of luminescence of the organic EL device 1, and also, a voltage drop between the cathode and the anode of the organic EL device 1 is small, so that in the case where the on-condition of the power supply switch 2 is the complete on-condition causing the power supply switch transistor to be in the unsaturation condition, about 10 to 11 V corresponding to most of a power supply voltage applied between the common electrode 8 and the ground line 7 comes to be applied between the drain and the source of the drive TFT 3.

However, since the on-condition of the power supply switch 2 is the incomplete ON causing the power supply switch transistor to be in the saturation condition, the voltage at (5 V−Vth) or higher will never be applied to the point "A" corresponding also to the drain of the drive TFT 3. As a result, a voltage between the drain and the source of the drive TFT 3, which is an nMOS, is controlled below (5 V−Vth), so that deterioration of the drive TFT 3 will never become a problem.

Further, there are times when most of the power supply voltage applied between the common electrode 8 and the ground line 7 is applied to respective ends of the power supply switch 2 when the power supply switch 2 is in the off condition. However, in such a case, a channel current is 0 during a switch-off period when current flowing through the power supply switch 2 is 0, so that the deterioration will not become a problem, and further, because during a period of transition between turn-on and turn-off, an extremely high speed occurs, the deterioration will not become a problem either.

Next, a configuration of a display panel according to the present embodiment is described hereinafter with reference to FIG. 3.

Figure 3:
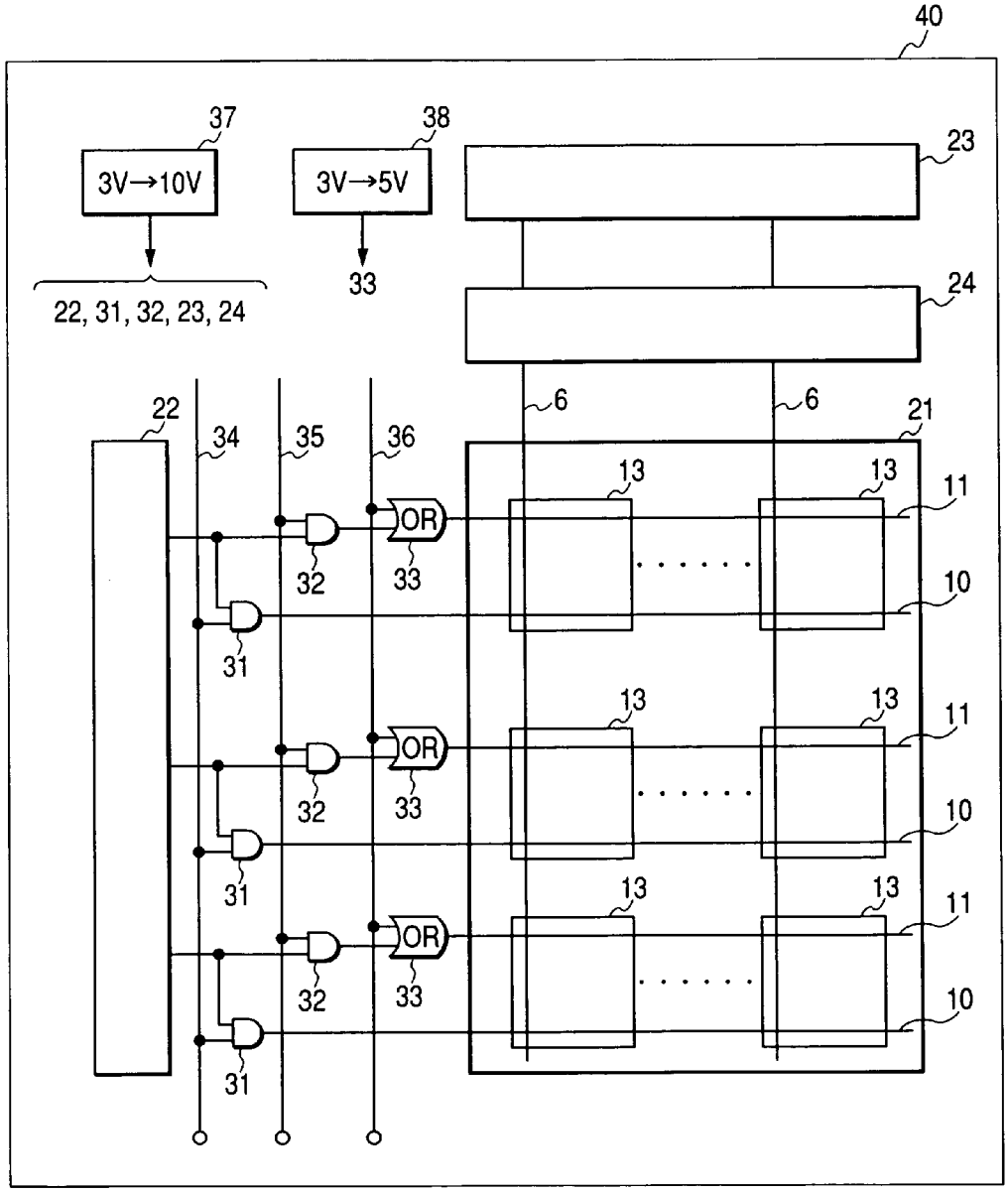
FIG. 3 is a block diagram of an organic EL display panel according to the first embodiment.

FIG. 3 is a block diagram of an organic EL display panel according to the present embodiment. The pixels 13 are disposed in a matrix fashion in a display region 21, and the signal lines 6 extending in the vertical direction, the power supply control lines (PWR+) 11, and the reset control lines (RST) 10, both extending in the horizontal direction, are connected to the pixels 13, respectively. One end of each of the signal lines 6 leads to a signal voltage generation circuit 23 via a switchover circuit 24 for switching over between the data signal DT and the triangular wave signal SS.

The drive voltage PWR+of the power supply control line 11 is connected to a logical sum OR circuit 33 provided in every row of the respective pixels 13, one of inputs of the logical OR circuit 33 is connected to a logical product (AND) circuit 32, and one of inputs of the AND circuit 32 is further connected to a vertical pixel-scanning circuit 22. The reset control lines (RST) 10 each are connected to an AND circuit 31 provided in every row of the respective pixels 13, and one of inputs of the AND circuit 31 is further connected to the vertical pixel-scanning circuit 22.

The other ends of the inputs of the AND circuits 31, 32, and the OR circuits 33, respectively, are connected in common with a reset control-timing control line 34, a write-time power supply control-timing control line 35, and a luminescence-time power supply control-timing control line 36, all extending in the vertical direction, respectively. As the designations of the respective lines indicate, the reset control-timing control line 34 is a line for transmitting a signal for controlling the reset control line for a pixel row selected by the vertical pixel-scanning circuit 22, the write-time power supply control-timing control line 35 is a line for transmitting a signal for controlling the power supply control line at a write-time for a pixel row selected by the vertical pixel-scanning circuit 22, and the luminescence-time power supply control-timing control line 36 is a line for transmitting a signal for controlling the power supply control line at a luminescence-time for all the pixels.

As shown in the figure, an intra-panel 10 V generation circuit 37 for receiving a 3 V voltage to thereby generate a 10 V voltage supplies the power supply voltage to the vertical pixel-scanning circuit 22, the AND circuits 31, 32, the signal voltage generation circuit 23, and the switchover circuit 24, respectively. Further, an intra-panel 5 V generation circuit 38 for receiving a 3 V voltage to thereby generate a 5 V voltage supplies the power supply voltage to the OR circuits 33, respectively. Thus, with the present embodiment, there are provided two kinds of the power supply voltage generation circuits 37, 38, matching two kinds of circuits driven by different voltages, respectively.

FIG. 3 shows only 6 pieces of the pixels for simplification of the figure, however, the number of the pixels is, in fact, 640

(horizontal)×RGB×480 (vertical). The pixels 13 disposed within the display region 21, the data signal/triangular wave signal switchover circuit 24, the signal voltage generation circuit 23, the vertical pixel-scanning circuit 22, the AND circuits 31, 32, the OR circuits 33, the intra-panel 10 V generation circuit 37, and the intra-panel 5 V generation circuit 38, each making use of a polycrystalline Si-TFT, are all provided over a single glass substrate 40.

Lastly, a structure of the organic EL device 1 according to the present embodiment is described with reference to FIG. 4.

Figure 4:
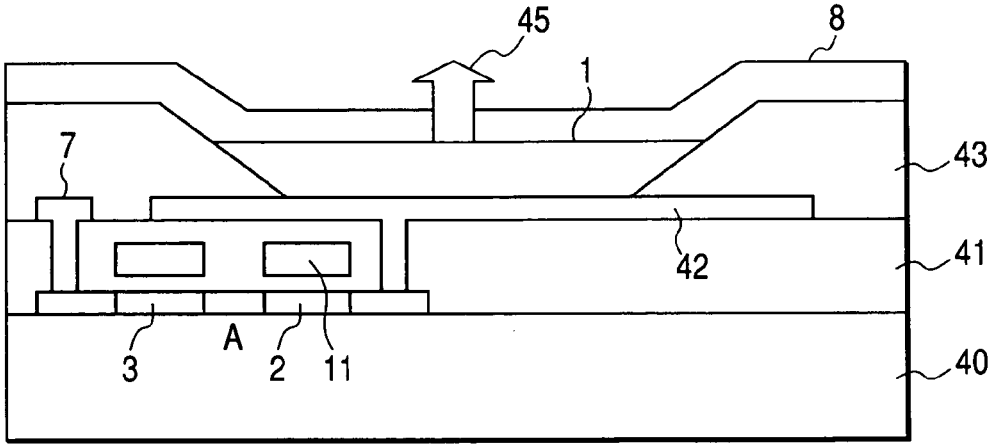
FIG. 4 is a view showing a structure of an organic EL device according to the first embodiment.

FIG. 4 is a sectional view showing the pixel in the vicinity of the organic EL device 1 according to the present embodiment. The power supply switch 2, and the drive TFT 3 are provided over the glass substrate 40, and the power supply switch 2 is provided with the power supply control line 11 serving as a gate interconnect. Further, the ground line 7 that is a metal layer is connected to one end of the drive TFT 3. A metal layer identical in level to the ground line 7, serving as a cathode electrode 42, is connected to one end of the power supply switch 2, and over the cathode electrode 42, there are provided a luminescence layer of the organic EL device 1, and the transparent common electrode 8 serving as an anode electrode. Further, a protection film 43 for avoiding field convergence at the edge of the organic EL device is formed on the periphery of the luminescence layer of the organic EL device 1.

When the power supply switch 2 is turned half-ON, and the drive TFT 3 is turned ON by the triangular wave signal SS, a predetermined current flows to the organic EL device 1, whereupon luminescence 45 of the organic EL device 1 is reflected by the cathode electrode 42 to be then transmitted through the transparent common electrode 8 with hardly any attenuation, thereby effecting display.

With the present embodiment, TFTs inside the respective pixels are all nMOS transistors formed of polycrystalline Si, however, if polarity of respective control voltage is reversed, pMOS transistors can be used where appropriate, and furthermore, other organic/inorganic semiconductor thin films, other than polycrystalline Si, can be used in the transistors.

Further, it is obvious that a light emitting device is not limited to the organic EL device and a common light emitting device such as an inorganic EL device, FED (Field-Emission Device), and so forth can be used as the light emitting device. With the present embodiment, detailed description of the luminescence layer is omitted because the same does not represent the essence of the invention, however, various molecular structures such as a low-molecular type, polymer type and so forth can be adopted as the structure of the organic EL device.

Further, with the present embodiment, the ground line 7 is at a potential of 0 V, but it goes without saying that the potential need not necessarily be at 0 V, and the luminescence voltage of the organic EL device 1, and the respective control voltages may be altered as necessary without departing from the spirit and scope of the invention.

Second Embodiment

A second embodiment of an image display apparatus according to the invention is described with reference to FIGS. 5 and 6.

Figure 5:
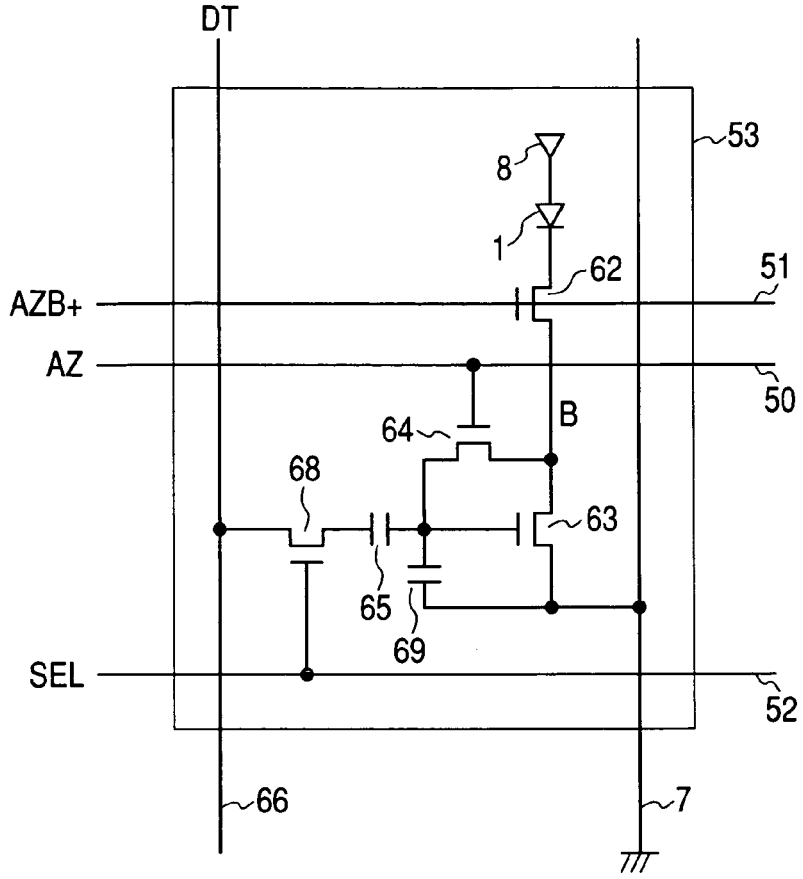
FIG. 5 is a pixel circuit diagram of an organic EL display showing a second embodiment of an image display apparatus according to the invention.

FIG. 5 is a pixel circuit diagram of an organic EL display according to the present embodiment. Respective pixels 53 are provided with an organic EL device 1, and the organic EL device 1 has one end connected to a transparent common electrode 8, and the other end connected to a ground line 7 via an AZB+switch 62, and a drive TFT 63. An AZ switch 64 interconnects the gate and the drain of the drive TFT 63, and a storage capacitor 69 is coupled between the gate and the source thereof. Further, the gate of the drive TFT 63 is coupled to a signal line 66 via an offset cancel storage capacitor 65, and a pixel switch 68. The AZB+switch 62 is controlled by an AZB+control line 51, the AZ switch 64 is controlled by an AZ control line 50, and the pixel switch 68 is controlled by a select signal SEL of a signal line 52, respectively.

Next, an operation of the present embodiment is described with reference to FIG. 6.

Figure 6:
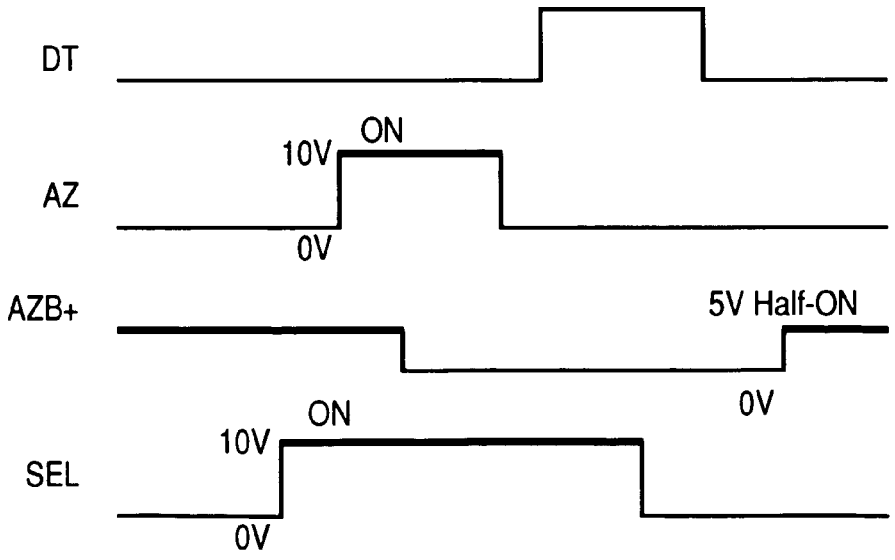
FIG. 6 is an operation timing chart of a pixel according to the second embodiment.

FIG. 6 is an operation timing chart of the pixel according to the present embodiment. In this case, since an nMOS is used for the AZB+switch 62, the AZ switch 64, and the pixel switch 68, respectively, as shown in FIG. 5, upper parts of respective waveforms shown in FIG. 6 correspond to ON of the respective switches, and lower parts thereof correspond to OFF.

With the pixel selected for writing, the pixel switch 68 is first turned ON by the SEL signal line 52, and the AZ switch 64 is turned ON by the AZ control line 50. At this point in time, the AZB+switch 62 is in the half-on condition, so that current flows from the common electrode 8 to the organic EL device 1 via the AZB+switch 62, and the drive TFT 63 connected to a diode.

Next, when the AZB+switch 62 is turned OFF by the AZB+control line 51, the drive TFT 63 is turned OFF upon a voltage at a drain end of the drive TFT 3 turning to a threshold voltage Vth. At this point in time, signal voltage data DT at "0 level" has already been applied to the signal line 66, and a difference between this voltage and the threshold voltage Vth is inputted to the offset cancel storage capacitor 65.

Subsequently, after the AZ switch 64 is turned OFF by the AZ control line 50, the image signal voltage data DT is applied to the signal line 66. At this point in time, a voltage corresponding to the image signal voltage added to the threshold voltage Vth is generated at the gate of the drive TFT 63 to be then stored in the storage capacitor 69 as a result of the pixel switch 68 being turned OFF by the SEL line 52.

Thereafter, the AZB+switch 62 is turned half ON, thereby completing writing of the signal voltage to the pixel, and the organic EL device 1 continues luminescence at a luminance corresponding to a differential voltage between the image signal voltage and the "0 level" voltage until a succeeding write-time.

The present embodiment is similar to a conventional technology as described in, for example, SID 98 Digest of Technical Papers, pp. 11-14 (refer to SID 98 Digest of Technical Papers, 1998, pp. 11-14).

The present embodiment, however, differs largely from the conventional technology in that an on-voltage of the AZB+switch 62, caused by the AZB+control line 51, is not 10 V representing complete-on, but 5 V representing half-on. This means that an on-condition of the AZB+switch 62 is not a complete ON causing the AZB switch transistor to be in an unsaturation condition, but an incomplete ON causing the same to be in a saturation condition.

As with the first embodiment, in this case, a voltage at a point "B" shown in FIG. 5, corresponding to a source point of the AZB+switch 62, will not be a half-ON voltage (5 V−Vth) or higher even if the AZB+switch 62 is turned ON. The reason for this is because when the voltage at the point "B" rises up to the voltage at (5 V−Vth), the AZB+switch 62 is turned OFF. With the present embodiment as well, a luminescence voltage of the organic EL device 1, applied to the common electrode 8, is about 10 V for green color and red color, respectively, and about 11 V for blue color.

It has been described in the foregoing that the voltage corresponding to the image signal voltage data DT added to the threshold voltage Vth is generated at the gate of the drive TFT 63, and as a result of the AZB+switch 62 being turned half-ON, the organic EL device 1 continues luminescence at the luminance corresponding to the differential voltage between the image signal voltage and the "0 level" voltage until the succeeding write-time, however, if the image signal voltage is low in level, and the luminance of the luminescence of the organic EL device 1 is weak at this point in time, the drive TFT 63 is weakly turned ON, and concurrently, a voltage drop between the cathode and the anode of the organic EL device 1 is small, so that in the case where the on-condition of the AZB+switch 62 is complete-ON causing the AZB switch transistor to be in the unsaturation condition, about 10 to 11 V corresponding to most of the power supply voltage applied between the common electrode 8 and the ground line 7 comes to be applied between the drain and the source of the drive TFT 63.

However, since the on-condition of the AZB+switch 62 is the incomplete ON causing the AZB switch transistor to be in the saturation condition, the voltage at (5 V−Vth) or higher will never be applied to the point "B" corresponding to the drain of the drive TFT 63. As a result, a voltage between the drain and the source of the drive TFT 63, which is an nMOS, is controlled below (5 V−Vth), so that deterioration of the drive TFT 63 will never become a problem.

Further, there are times when most of the power supply voltage applied between the common electrode 8 and the ground line 7 is applied to respective ends of the AZB+switch 62 when the AZB+switch 62 is in the off-condition. However, in such a case, a channel current is 0 during a switch-Off period when current flowing through the AZB+switch 62 is 0, so that the deterioration will not become a problem, and further, because during a period of transition between turn-on and turn-off, an extremely high speed occurs, the deterioration will not become a problem either. In this respect, the AZB+switch 62 according to the present embodiment play the same role as that played by the power supply switch 2 according to the first embodiment.

As the present embodiment is similar to the first embodiment in respect of a configuration of a display panel and a structure of the organic EL device 1, disclosure thereof is omitted herein for brevity in description.

Third Embodiment

A third embodiment of an image display apparatus according to the invention is described with reference to FIG. 7.

Figure 7:
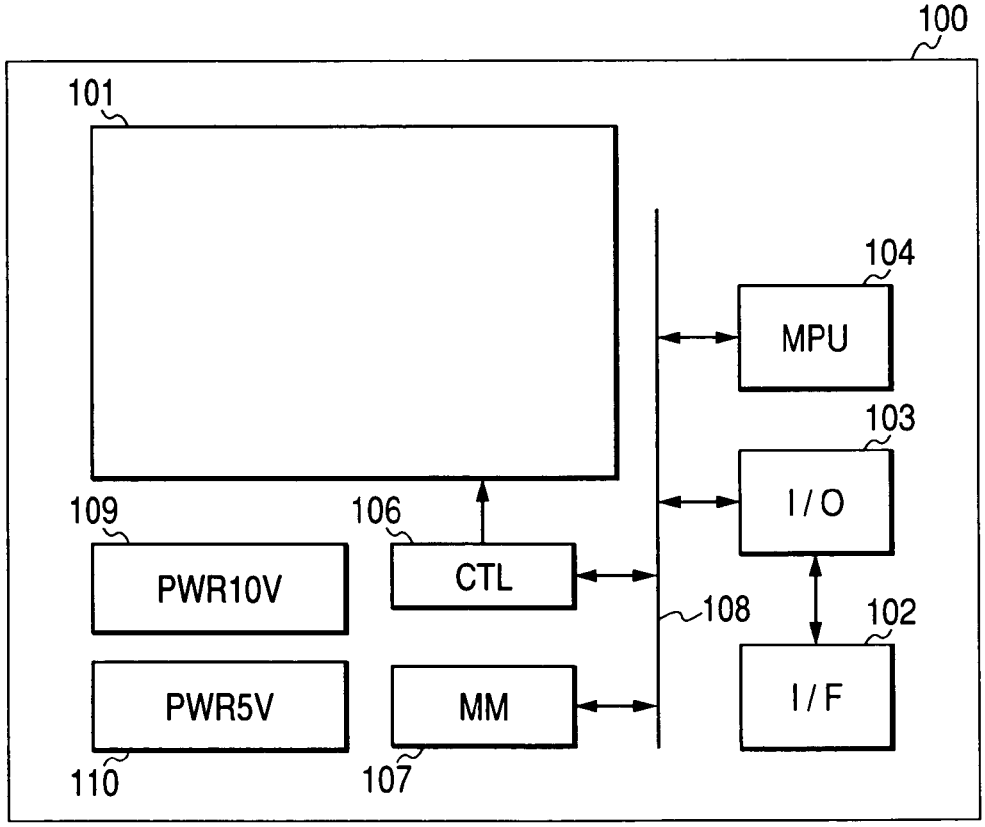
FIG. 7 is a block diagram of a TV image display apparatus showing a third embodiment of an image display apparatus according to the invention.

FIG. 7 is a block diagram of a TV image display apparatus 100 according to the third embodiment. Compressed image data, and so forth, as wireless data, are inputted from outside to a wireless interface (I/F) circuit 102 for receiving ground wave digital signals, and so forth, and an output of the wireless I/F circuit 102 is connected to a data bus 108 via an I/O (input/output) circuit 103. A microprocessor (MPU) 104, a display panel controller (CTL) 106, a frame memory (MM) 107, and so forth, besides the above-described, are connected to the data bus 108. Further, an output of the display panel controller 106 is inputted to an organic EL display panel 101. In addition, an out-of-panel 10 V generation circuit (PWR 10 V) 109, and an out-of-panel 5 V generation circuit (PWR 5 V) 110 are provided inside the TV image display apparatus 100. Now, the organic EL display panel 101 is basically identical in configuration and operation to the organic EL display panel according to the first embodiment previously described, omitting therefore description of an internal configuration, and operation thereof. With the first embodiment, however, the intra-panel 10 V generation circuit 37, and the intra-panel 5 V generation circuit 38, each using the polycrystalline Si-TFT, are provided inside the organic EL display panel, and in contrast, with the present embodiment, those circuits are provided outside the panel as the out-of-panel 10 V generation circuit (PWR 10 V) 109, and the out-of-panel 5 V generation circuit (PWR 5 V) 110, using individual components, respectively.

An operation of the present embodiment is described hereinafter. First, the wireless I/F circuit 102 fetches the compressed image data from outside according to an instruction, and transfers the image data to the microprocessor 104, and the frame memory 107 via the I/O circuit 103. Upon receiving an operation instruction from a user, the microprocessor 104 drives the TV image display apparatus 100 in whole as necessary to thereby execute decoding of the compressed image data, signal processing, and information display. At this point in time, the image data after the signal processing can be temporarily stored in the frame memory 107.

In the case where the microprocessor 104 issues a display instruction at this point in time, the image data are inputted from the frame memory 107 to the organic EL display panel 101 via the display panel controller (CTL) 106 according to the instruction, whereupon the organic EL display panel 101 displays the image data as inputted in real time. At this point in time, the display panel controller (CTL) 106 outputs a predetermined timing pulse necessary for simultaneously displaying images while the out-of-panel 10 V generation circuit (PWR 10 V) 109, and the out-of-panel 5 V generation circuit (PWR 5 V) 110 each supply a predetermined power supply voltage to the organic EL display panel 101. The operation of the organic EL display panel 101, for displaying the image data as inputted in real time by making use of those signals and the power supply voltages is the same as that described with reference to the first embodiment. Further, the TV image display apparatus 100 incorporates a secondary battery provided separately for supplying power to drive the TV image display apparatus 100 in whole, which does not represent the essence of the invention, therefore omitting description thereof.

With the present embodiment, it is possible to provide the TV image display apparatus 100 capable of effecting display at a high luminance with high reliability. Further, with the present embodiment, for an image display device, use is made of the organic EL display panel described with reference to the first embodiment; however, it is obviously possible to use a display panel having structures other than that for the above without departing from the essence of the invention.

With the respective embodiments described hereinbefore, even when luminance of the luminescence of the light emitting device is small, the power supply voltage is dispersed into the transistor switches, so that it is possible to avoid deterioration of the pixel drive circuit using the nMOS. As a result, the TV image display apparatus capable of effecting display at a high luminance with high reliability can be provided.

What is claimed is:

1. An image display apparatus comprising:

a gradation signal voltage generation circuit; and a display region in which a plurality of pixels are arranged in a matrix fashion, and wherein each pixel includes a light emitting device with luminance being controlled in analogue by the gradation signal voltage generation circuit, and a luminance control circuit for the light emitting device, the light emitting device of each pixel having first and second terminals, wherein the luminance control circuit of each pixel comprises an nMOS transistor as a drive TFT having a source that is applied a constant voltage and operating in a saturation region, wherein each pixel further comprises an nMOS transistor switch as a power supply switch and a reset switch, wherein, for each pixel, the power supply switch is provided between the first terminal of the light emitting device and a drain of the drive TFT included in the luminance control circuit, the power supply switch has a drain side thereof connected to the first terminal of the light emitting device and a source side thereof connected to the drain of the drive TFT included in the luminance control circuit, and a gate voltage of the power supply switch is controlled by a power supply control line on a binary basis of ON/OFF, wherein, for each pixel, the reset switch has a source thereof connected to the drain of the drive TFT, a drain thereof connected to a signal line via a signal storage capacitor and connected to a gate of the drive TFT, and a gate thereof connected to a reset control line, wherein, for a pixel that is selected for writing:

in a signal voltage write time period that is a first half of one frame period, the power supply switch is first turned ON by a drive voltage applied by the power supply control line, the reset switch is subsequently turned ON by an RST signal applied via the reset control line so that current flows from a common electrode to the light emitting device via the drive TFT and the power supply switch, the power supply switch is turned OFF by the drive voltage applied by the power supply control line so that the drive TFT is turned OFF at a time when a voltage at the drain of the drive TFT becomes a threshold voltage Vth, a predetermined data signal voltage has already been applied to the signal line, and a difference between the data signal voltage and the threshold voltage Vth is input to the signal storage capacitor, and the reset switch is subsequently turned OFF by the RST signal of the reset control line so that the signal voltage is stored in the signal storage capacitor, thereby completing writing of the signal voltage to the pixel, in a luminescence display time period that is subsequent second half of the one frame period, a predetermined triangular wave signal of an analog signal is input to each of the plurality of pixels via the signal line, the power supply switch is turned ON by the drive voltage applied by the power supply control line, and the threshold voltage Vth is input to the gate of the drive TFT if the triangular wave signal applied to the signal line is equivalent to the signal voltage written to the pixel in the signal voltage write time period so that a luminescence period of the light emitting device is determined according the signal voltage written to the pixel, and wherein an on-voltage of the power supply switch that results from the drive voltage applied by the power supply control line represents a half-ON condition of the power supply switch rather than a complete-ON condition.

2. An image display apparatus according to claim 1, wherein the light emitting device is an organic EL device.

3. An image display apparatus according to claim 1, wherein the display region is formed on an insulating substrate.

4. An image display apparatus according to claim 1, wherein a value of a voltage applied to the second terminal of the light emitting device varies depending on respective display colors of the light emitting device.

5. An image display apparatus according to claim 1, wherein the luminance control circuit of the light emitting device controls analogue luminance of the respective pixels by modulating respective luminescence intensity of the light emitting device in one frame period.

6. An image display apparatus according to claim 1, wherein the power supply switch of each pixel is controlled such that an operating point thereof at on-time occurs in a saturation region.

* * * * *